US008061725B1

(12) United States Patent
Hawkins

(10) Patent No.: US 8,061,725 B1
(45) Date of Patent: Nov. 22, 2011

(54) MOTORIZED SKATEDBOARD

(76) Inventor: James E. Hawkins, Northridge, CA (US)

( * ) Notice: Subject to any disclaimer, the term of this patent is extended or adjusted under 35 U.S.C. 154(b) by 0 days.

(21) Appl. No.: 12/660,882

(22) Filed: Mar. 4, 2010

Related U.S. Application Data

(60) Provisional application No. 61/158,171, filed on Mar. 6, 2009.

(51) Int. Cl.
*A63C 5/08* (2006.01)

(52) U.S. Cl. ..... 280/87.042; 280/87.041; 180/181

(58) Field of Classification Search ..... 280/87.042, 280/87.01, 87.021, 14.21, 14.27, 14.28, 43; 180/22, 65.1, 24.01, 65.31, 65.6, 24.03
See application file for complete search history.

(56) References Cited

U.S. PATENT DOCUMENTS

| | | | | |
|---|---|---|---|---|
| 4,062,557 | A * | 12/1977 | Roden | 280/87.042 |
| 4,069,881 | A * | 1/1978 | Shiber | 180/181 |
| 4,073,356 | A | 2/1978 | Schlicht | |
| 4,094,372 | A * | 6/1978 | Notter | 180/181 |
| 4,143,728 | A * | 3/1979 | Shiber | 180/181 |
| 4,183,546 | A * | 1/1980 | Heilig | 280/87.042 |
| 5,020,621 | A * | 6/1991 | Martin | 180/181 |
| 5,127,488 | A * | 7/1992 | Shanahan | 180/181 |
| 5,381,870 | A * | 1/1995 | Kaufman | 180/181 |
| 5,487,441 | A * | 1/1996 | Endo et al. | 180/181 |
| 5,893,425 | A * | 4/1999 | Finkle | 180/181 |
| 5,927,420 | A * | 7/1999 | Karrington | 180/181 |
| 5,975,229 | A * | 11/1999 | Hosoda | 180/181 |
| 6,050,357 | A * | 4/2000 | Staelin et al. | 180/65.1 |
| 6,227,324 | B1 * | 5/2001 | Sauve | 180/228 |
| 6,343,667 | B2 * | 2/2002 | Sauve | 180/228 |
| 6,345,678 | B1 * | 2/2002 | Chang | 180/181 |
| 6,702,634 | B2 * | 3/2004 | Jung | 441/74 |
| 6,796,394 | B1 * | 9/2004 | Lin | 180/181 |
| 6,848,527 | B2 * | 2/2005 | Nelson | 180/181 |
| 6,901,872 | B1 * | 6/2005 | Battle et al. | 114/55.56 |
| 7,147,235 | B2 * | 12/2006 | West | 280/87.042 |
| 7,172,044 | B2 * | 2/2007 | Bouvet | 180/181 |
| 7,293,622 | B1 * | 11/2007 | Spital | 180/181 |
| 7,811,217 | B2 * | 10/2010 | Odien | 482/147 |
| 2001/0035308 | A1 * | 11/2001 | Sauve | 180/228 |
| 2002/0074176 | A1 * | 6/2002 | Justus et al. | 180/181 |
| 2004/0021281 | A1 * | 2/2004 | Stephens, Jr. | 280/87.042 |
| 2004/0065494 | A1 * | 4/2004 | Nelson | 180/181 |
| 2004/0163867 | A1 * | 8/2004 | Hillman | 180/180 |
| 2004/0200651 | A1 * | 10/2004 | West | 180/181 |
| 2004/0206562 | A1 * | 10/2004 | Lin | 180/181 |
| 2005/0006158 | A1 * | 1/2005 | Tsai | 180/167 |
| 2005/0139406 | A1 * | 6/2005 | McLeese | 180/180 |
| 2006/0032682 | A1 * | 2/2006 | Hillman et al. | 180/65.1 |
| 2006/0049595 | A1 * | 3/2006 | Crigler et al. | 280/87.042 |
| 2006/0131084 | A1 * | 6/2006 | Rupp | 180/65.1 |
| 2007/0262546 | A1 * | 11/2007 | Bertiller | 280/87.042 |
| 2007/0272465 | A1 * | 11/2007 | Su | 180/181 |

* cited by examiner

*Primary Examiner* — J. Allen Shriver, II
*Assistant Examiner* — James Triggs
(74) *Attorney, Agent, or Firm* — Albert O. Cota

(57) ABSTRACT

A motorized skateboard (10) having an electric motor (102) that rotates a rear fifth drive wheel (86) that extends behind the rear truck (36) of the motorized skateboard (10). The drive wheel (86), which is biased downward by the force of gravity, interfaces with the surface of the ground. A hand-held cable assembly (140) having a power switch (142) controls the operation of the electric motor (102) which applies power to and causes the rear drive wheel (86) to rotate. The rotating drive wheel (86) further causes the motorized skateboard (10) to be propelled forward. The forward motion will continue as long as the rider depresses the power switch (142).

13 Claims, 6 Drawing Sheets

MOTORIZED SKATEDBOARD

This application claims priority of Provisional Patent Application No. 61/158,171 filed Mar. 6, 2009.

TECHNICAL FIELD

The invention generally pertains to skateboards, and more particularly to a motorized, self-propelled skateboard.

BACKGROUND ART

As is well known in the prior art, a skateboard typically includes an elongated board, sometimes referred to as a deck, having an upper surface and a lower surface. The upper surface supports the feet of the skateboard rider and the lower surface has two sets of trucks that are longitudinally spaced. Skateboard trucks have attached front and back sets of wheels that have the ability to both travel over an up and down range as well as pivot around a central point forward and aft. A central axle extends through the trucks and into the wheels which are rotatably attached to the ends of the trucks.

The rider stands on the upper surface of the board and by shifting the location of the feet and center of gravity, tilts the board to cause change of direction. Conventional skateboards require that a rider provide the propelling force to move, in the form of placing one of the rider's feet on the ground and pushing with that foot as the other foot remains on the top surface of the board. By virtue of the manual propulsion, a conventional skateboard has limitations in both speed as well as the fact that the rider can tire over a period of time. Perhaps it is for these reasons that conventional skateboards are typically used by adolescents and much less by adults.

A search of the prior art did not disclose any literature or patents that read directly on the claims of the instant invention. However, the following U.S. patents are considered related:

| U.S. PAT. NO. | INVENTOR | ISSUED |
|---|---|---|
| 4,073,356 | Schlicht | 14 Feb. 1978 |
| 5,020,621 | Martin | 4 Jun. 1991 |
| 5,487,441 | Endo et al | 30 Jan. 1996 |
| 5,893,425 | Finkle | 13 Apr. 1999 |
| 2004/0163867 | Hillman | 26 Aug. 2004 |
| 6,848,527 | Nelson | 1 Feb. 2005 |
| 7,172,044 | Bouvet | 6 Feb. 2007 |

U.S. Pat. No. 5,020,621 issued to Martin, U.S. Pat. No. 5,893,425 issued to Finkle, and U.S. publication 2004/0163867 issued to Hillman each disclose a motorized skateboard that mounts an engine or a motor at the rear end of the skateboard and utilizes a transmission to mechanically transmit rotary power from the motor to a wheel or wheels of a skateboard truck. While these attempts create propulsion for the skateboard, certain issues are created. When only turning a single wheel, the wheel turns on one side at a different speed than on the other side. Moreover, the wheels and trucks of conventional skateboards are able to pivot and move somewhat, as described previously. Designing and incorporating a transmission or differential between the motor and the skateboard wheel it adds cost and complexity to the device. Moreover, the skateboard cannot turn or move as it typically does, and thus the skateboard loses its "feel", maneuverability and performance.

Yet other designs have incorporated a fifth wheel in roughly the center of the board. Examples of these include U.S. Pat. No. 4,073,356 issued to Schlicht, and U.S. Pat. No. 5,487,441 issued to Endo et al which disclose the use of a fifth driven wheel disposed intermediate the front and rear trucks or sets of wheels of the skateboard. These designs utilize an engine and battery which are also positioned mid-board. The driven fifth wheel in each case is rigidly, but rotatably, mounted to the skateboard. On non-even terrain, it may be difficult for the wheel to follow the terrain in a manner that can maintain traction with the ground so that there are no interruptions in propulsion of the skateboard. This also creates difficulties for traction if there are protrusions or bumps that the skateboard encounters.

Another disadvantage of the Schlicht arrangement is that a portion of the wheel as well as the motor and controls and the like are disposed on the upper surface of the board. U.S. Pat. No. 6,848,527 issued to Nelson also has such an arrangement. Of course, it should be appreciated by those skilled in the art that Nelson's design presents an impediment when the rider positions his feet or body.

Furthermore, positioning a fifth wheel between the trucks of the skateboard creates a completely different ride and feel than that of a conventional skateboard. U.S. Pat. No. 7,172,044 to Bouvet provides a non-motorized, self-propelled wheel board having a large wheel in the middle thereof, and describing the riding sensation as surfing on the ground.

Accordingly, there is a continuing need for a motorized skateboard which provides riding and maneuvering capabilities and characteristics which are identical, or nearly identical, to that of most conventional skateboards. The present invention fulfills these needs, and provides other related advantages as described below.

DISCLOSURE OF THE INVENTION

The motorized skateboard disclosed herein is capable of being riden in a similar manner as a conventional non-motorized skateboard. The motorized skateboard includes an elongated skateboard deck having an upper surface that supports the unfettered feet of the rider, similar to a conventional skateboard. On the bottom surface of the skateboard deck is attached a front truck that supports a pair of wheels, and a rear truck that supports a rear pair of wheels in a manner similar to a conventional skateboard. The wheels rotate freely and the trucks are able to pivot and move as do the trucks and wheels of a conventional skateboard.

The motorized skateboard includes an inventive rear fifth drive wheel which is coupled to an electric motor that is energized by a battery whose output is controlled by means of a hand-held power control cable. The hand-held power control cable includes a manually controlled power switch. When the power switch is manually depressed energy is provided to the motor that then rotates the rear drive wheel. When the switch is not depressed, no power is provided to the motor, therefore the rear drive wheel is not actively rotated and driven. However, the rear drive wheel can still rotate freely so as not to impede the travel of the motorized skateboard.

On the bottom surface of the skateboard deck is also located the front truck and associated wheels which are longitudinally spaced from the rear truck. The trucks and wheel arrangement is similar to that of a conventional skateboard. That is, the slightly pivoting truck is mounted to a block or directly to the deck, and has an axle extending therethrough to which the freely rotating wheels are connected.

The electrical power applied to the motorized skateboard is provided by a battery pack which is attached to a battery bracket that is located approximately at the mid point of the lower surface of the deck intermediate the front truck and the rear truck. In this manner, there is generally an even distribution of weight between the front and rear trucks. Preferably, the battery is rechargeable which can be accomplished by variety of methods.

The electric motor is preferably comprised of a 24 volt d-c motor, which delivers the force to the rear drive wheel that propels the motorized skateboard. In the preferred embodiment, the fifth rear drive wheel and the motor are rotatably attached to the axle of the rear truck which enables the fifth rear drive wheel and the motor to pivot upward and downward to be in constant contact with the surface of the ground. In this manner, when the skateboard encounters uneven terrain, such as potholes, depressions, bumps, or the like, the motorized skateboard's forward propulsion is not interrupted.

The motor includes an axle that rotates when the motor is activated. A drive chain is connected between a drive sprocket attached to the shaft of the motor and to a drive-receiving sprocket located on the drive wheel. Thus, as the motor is activated and the axle and drive sprocket rotate, the chain also rotates, causing the drive-receiving sprocket to rotate and propel the skateboard.

It is also contemplated by the instant invention that a conventional skateboard can be used and retrofitted with the key components of the instant invention. That is, a unit including the fifth drive wheel, the motor and a set of side plates could be installed on the rear end of a conventional skateboard. Additionally, these components could be provided separately and installed by the rider, or provided as a single integrated unit which could be simply bolted onto the rear end of a conventional skateboard. Such a unit could include a rechargeable battery pack integral therewith, or one or more battery packs could be disposed on the lower surface of the conventional skateboard. Additionally, a disk brake can be installed on one side of the rear drive wheel. The disk brake would be activated by means of a hand-controlled cable-installed toggle mechanism that is operated by the rider of the motorized skateboard.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
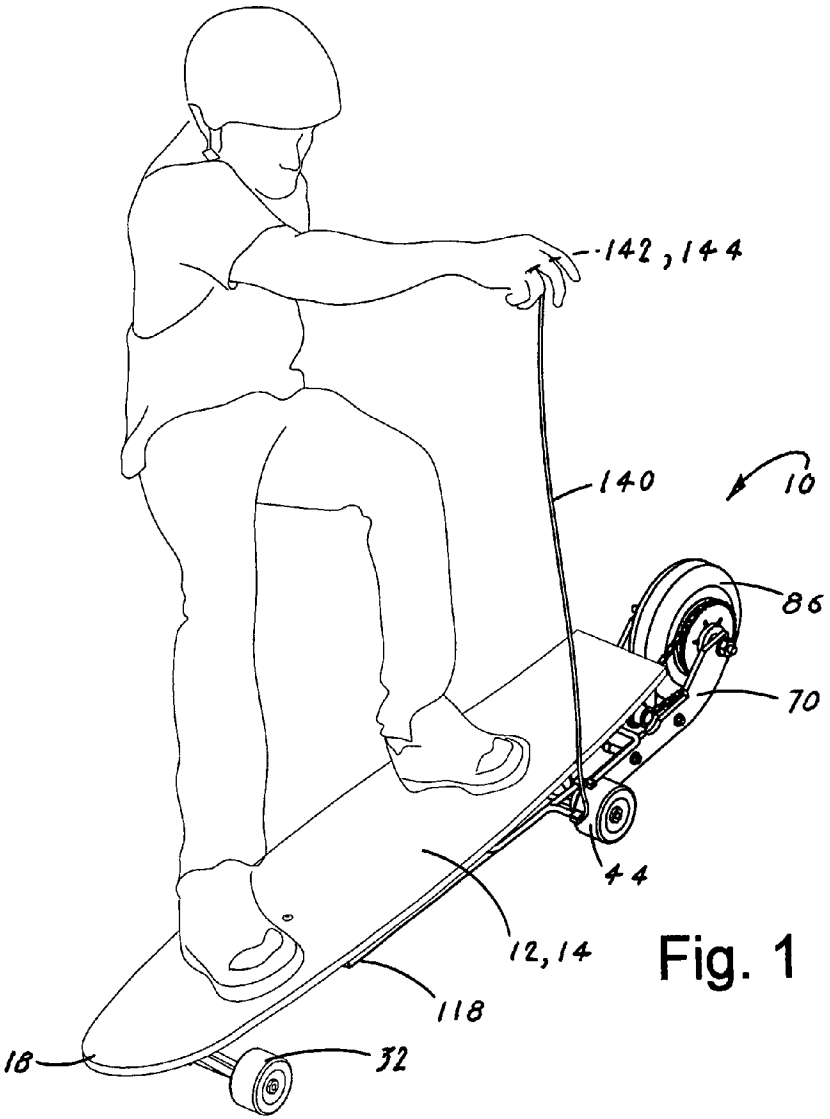
FIG. 1 is an isometric view of a person standing and operating a motorized skateboard.
Figure 3:
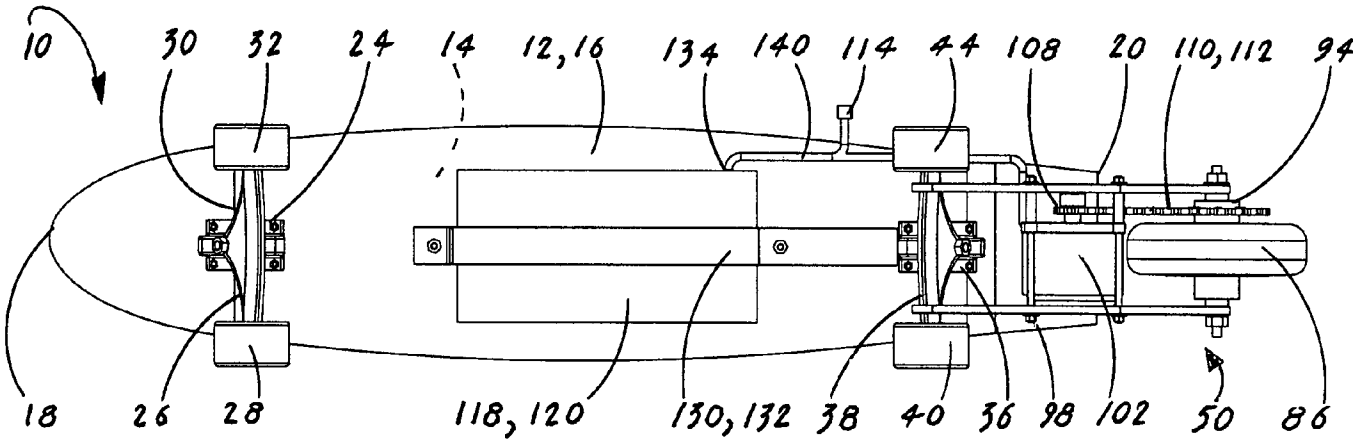
FIG. 3 is a bottom plan view of the motorized skateboard showing the relative location of a front truck, a rear truck, a rechargeable battery and a rear-wheel drive assembly.

The best mode for carrying out the invention is presented in terms that disclose a preferred embodiment of a motorized skateboard 10. The motorized skateboard 10, as shown in FIGS. 1-10, is comprised of the following six major elements: a skateboard deck 12, a front truck 24, a rear truck 36, a rear-wheel drive assembly 50, an electric motor 102 and a power source 118. A rider is shown in FIG. 1, standing on the skateboard deck 12 of the motorized skateboard 10.

Figure 7:
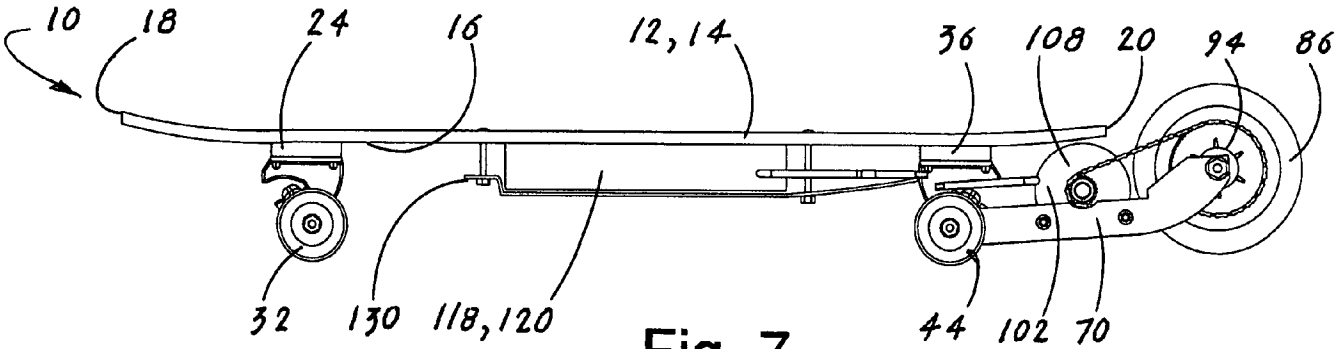
FIG. 7 is a left-side elevational view of the motorized skateboard.
Figure 6:
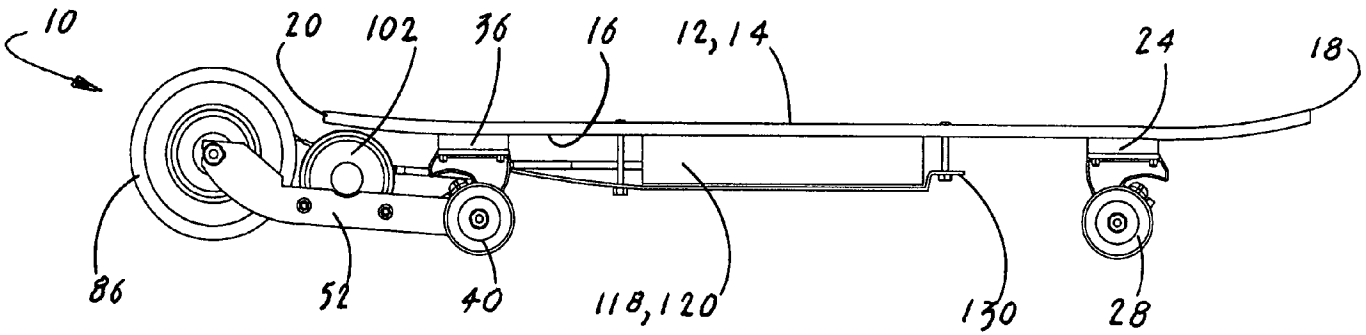
FIG. 6 is a right-side elevational view of the motorized skateboard.
Figure 9:
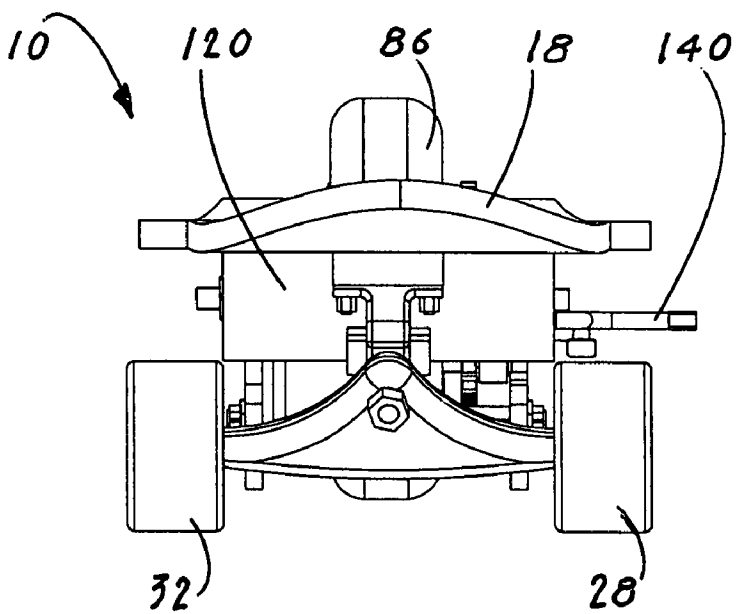
FIG. 9 is a front elevational view of the motorized skateboard.
Figure 8:
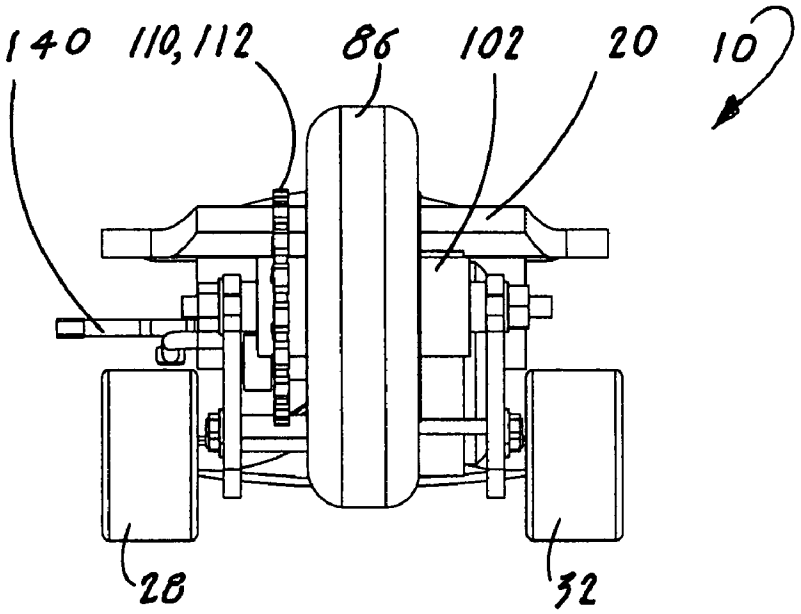
FIG. 8 is a rear elevational view of the motorized skateboard.

The skateboard deck 12, as shown best in FIGS. 2-5, has an upper surface 14, a lower surface 16, a front end 18 and a rear end 20. The front truck 24 is attached to the lower surface 16 proximate to the front end 18 of the skateboard deck 12. The front truck 24 has a right axle 26 that rotatably supports a right wheel 28, and a left axle 30 that rotatably supports a left wheel 32. Likewise, the rear truck 36 is attached to the lower surface 16 proximate to the rear end 20 of the skateboard deck 12. As shown in FIGS. 6 and 7, the rear truck 36 has a right axle 38 that rotatably supports a right wheel 40 and a left axle 42 that rotatably supports a left wheel 44.

The rear-wheel drive assembly 50 is designed to extend outward from the rear end 20 of the skateboard deck 12, as shown best in FIGS. 6 and 7. The assembly 50 is comprised of a right side plate 52, a left side plate 70, a rear fifth drive-wheel 86 and an electric motor 102. The assembly 50 is shown removed from the motorized skateboard 10 in FIG. 10.

The right side plate 52 has an outer side 54, an inner side 56, a front end 58 and a rear end 62. Located proximate to the front end 58 of the right side plate 52 is a right-axle bore 60 that is dimensioned to rotatably receive the right axle 38 of the rear truck 36. The rear end 62 of the right side plate 52 has a right wheel axle slot 64.

The left side plate 70 has an outer side 72, an inner side 74, a front end 76, and a rear end 80. The front end 76 has a left-axle bore 78 located proximate to the front end 76 of the left side plate 70. The left axle bore 78 is in alignment with the right axle bore 60 and is dimensioned to rotatably receive the left axle 42 of the rear truck 36. The rear end 80 has a left wheel axle slot 82 that is aligned with the right wheel axle slot 64. To allow the fifth drive wheel 86 to easily clear the surface of the ground, the rear end 62,80 of the right and left side plates 52,70 extend upward relative to the front end 58,76 of the plates 52,70.

Figure 10:
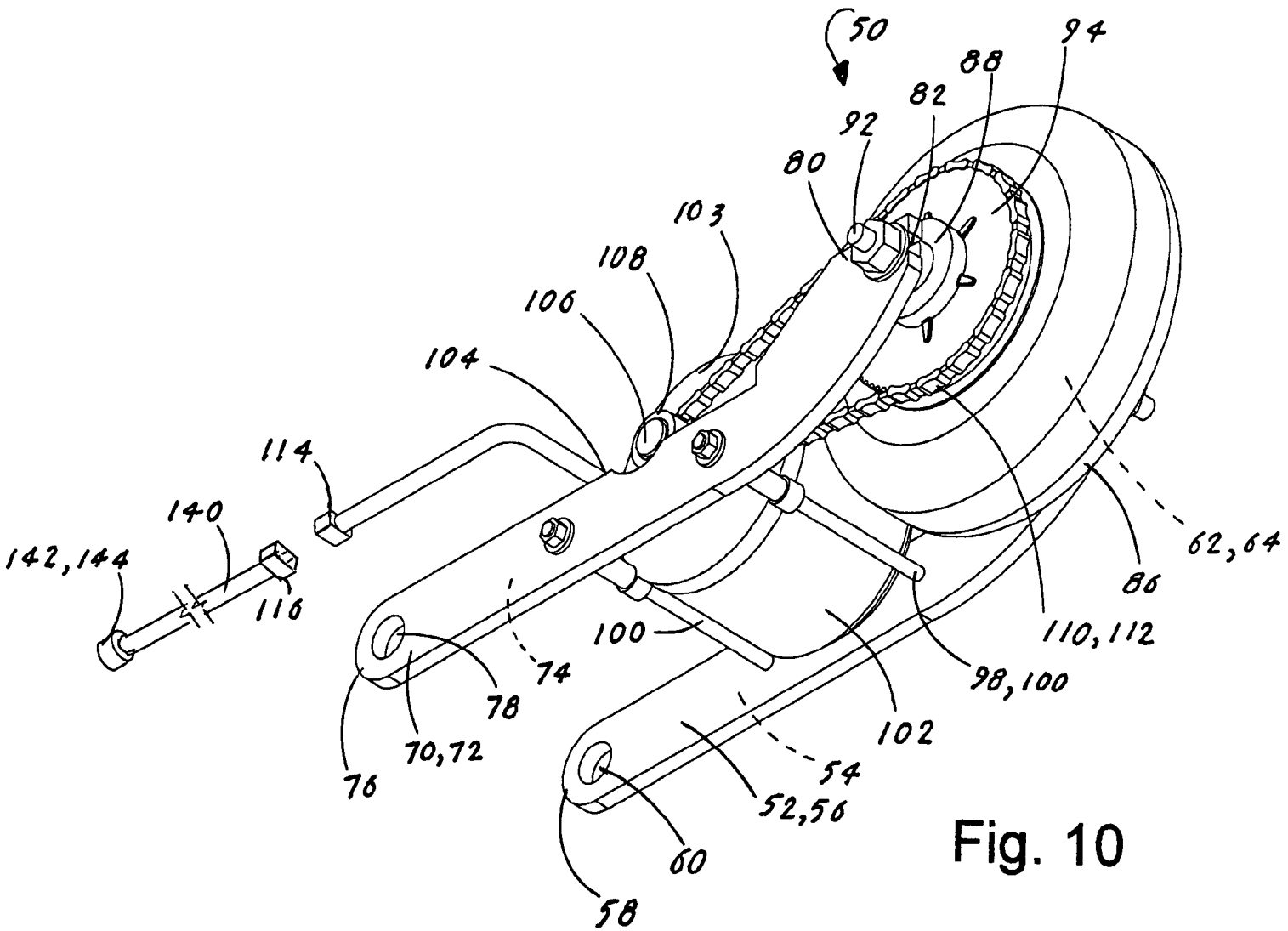
FIG. 10 is an isometric view of the rear-wheel drive assembly removed from the motorized skateboard.

The rear fifth drive-wheel 86, as shown in FIGS. 2, 3, 8 and 9, rotates about an axle 88 that has a right side 90 that fits into and is secured to the right wheel axle slot 64. Likewise, the left side 92 of the axle 88 fits into and is secured to the left wheel axle slot 82. To the left side of the axle 88 is rigidly inserted a drive-receiving sprocket 94, as shown in FIG. 10. The drive wheel 86 is preferably made of a solid material such as rubber, has a diameter that ranges from five to eight inches and its axle 88 is positioned from ten to sixteen inches behind the axle of the rear truck 36.

The electric motor 102 as shown best in FIG. 10, is secured to a motor attachment structure 98 that is comprised of two rods 100 that are attached between the inner side 56 of the right side plate 52 and to the inner side 74 of the left side plate 70. The two rods 100 are inserted into a face-plate 103 that is attached to the electric motor 102.

Figure 2:
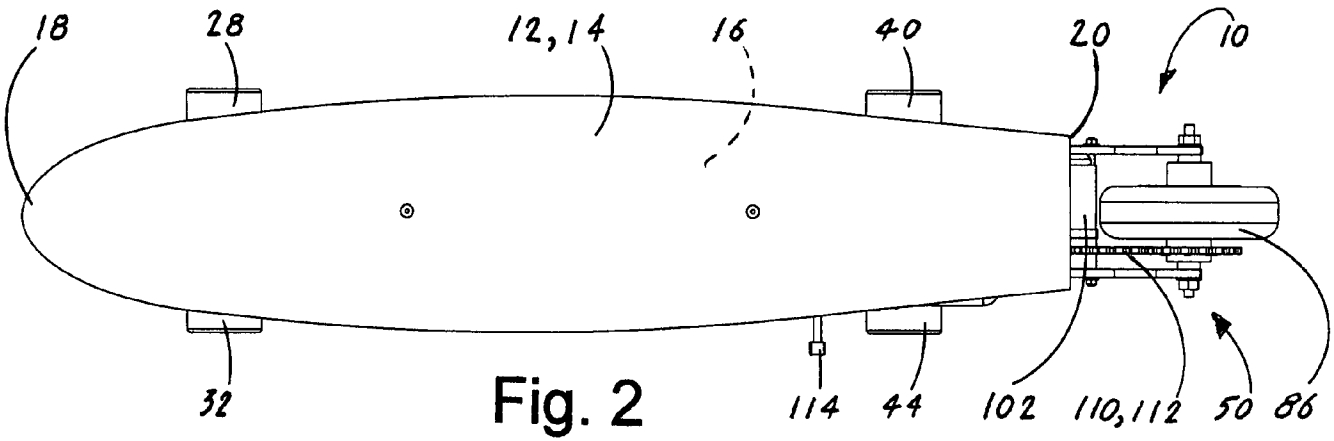
FIG. 2 is a top plan view of the motorized skateboard.
Figures 4, 5:
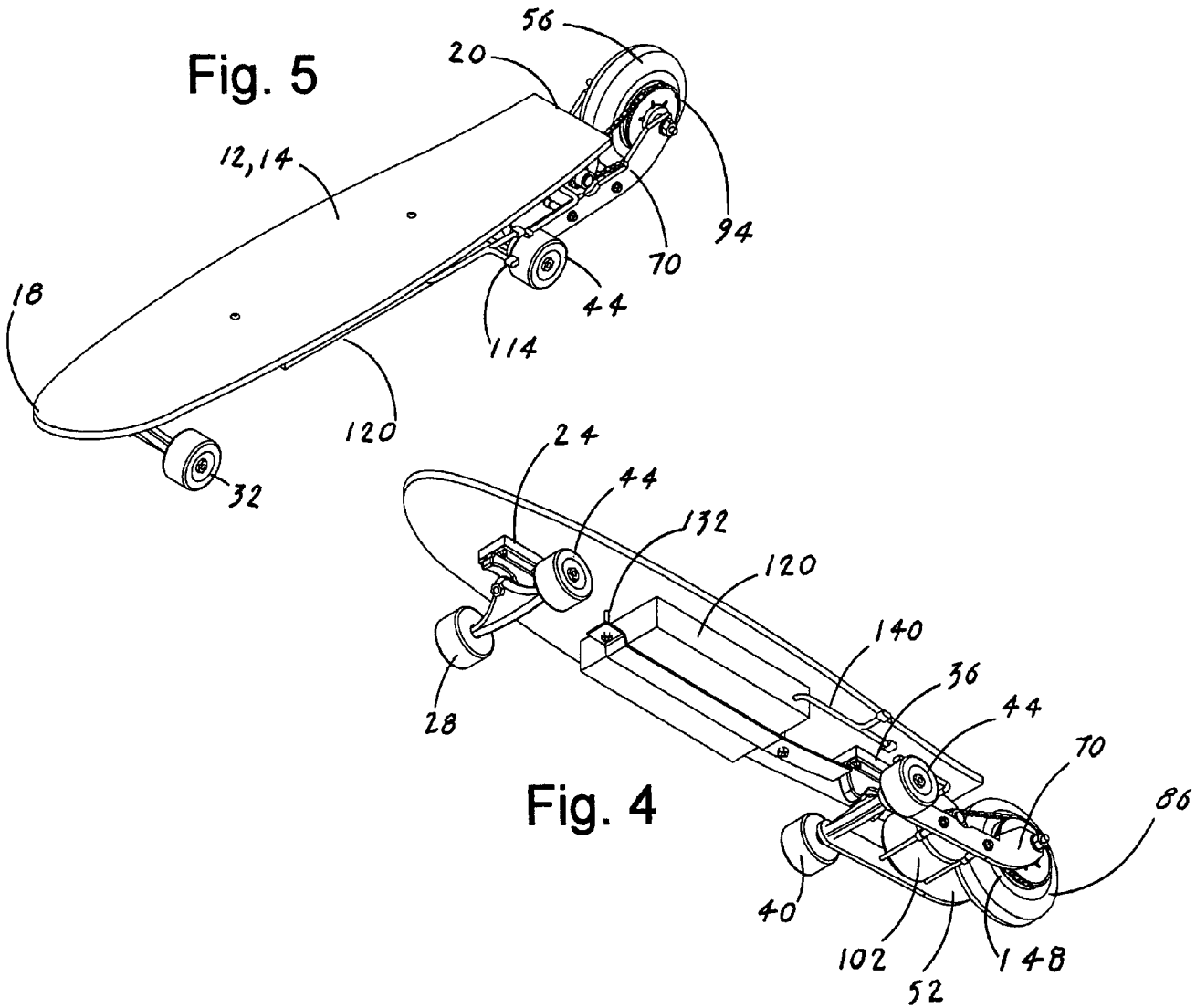
FIG. 4 is an isometric bottom view of the motorized skateboard.
FIG. 5 is an isometric top view of the motorized skateboard.

The electric motor 102, as shown in FIGS. 2 and 10, is comprised of a 24 volt d-c motor, having an electrical input 104 and a motor shaft 106. The electrical input 104 terminates at a female socket 114, as shown in FIG. 10. To the motor shaft 106 is attached a drive sprocket 108 that is in alignment with the drive-receiving sprocket 94 that is located on the left axle 42. The drive sprocket 108 drives the drive-receiving sprocket 94 by means of a sprocket drive band 110 that is attached around the two sprockets. The sprocket drive band 110 is preferably comprised of a drive chain 112, however a belt or the like can also be utilized. The drive-receiving sprocket 94 has a diameter that can range from 3.5 to 7.0 inches and has teeth that can range from 32 to 67. Likewise, the drive sprocket 108 has a diameter ranging from 1.0 to 3.5 inches and teeth ranging from 11 to 27.

The power source 118 is attached intermediate the front truck 24 and the rear truck 36 to provide an even distribution of weight. The power source 118 is preferably comprised of a rechargeable battery pack 120 that is attached by an attachment means 130 that consists of a cradle 132, that is attached to the lower surface 16 of the skateboard deck 12, as shown in FIGS. 6 and 7. The recharging of the battery pack 120 can be accomplished by:

a) plugging the battery pack 120 into a utility power source, b) utilizing a plurality of photovoltaic cells 126 that are attached to the upper surface 14 of the skateboard deck 12, and c) attaching the fifth drive wheel 86 to a generator 128 which supplies a charging current when the rear fifth drive-wheel 86 is free spinning. The battery charging methods described above are well known in the prior art.

The battery pack 120, which has an electrical output 134 of 24 volts d-c, is connected to the electrical input 104 on the electrical motor 102 by means of a cable assembly 140, as shown in FIG. 10. One end at the cable assembly 140 terminates with a male plug 116 that interfaces with the female socket 114. To the opposite end of the cable assembly 140, is attached a hard-wired a power switch 142. The power switch 142 is held and operated by a rider of the motorized skateboard 10, as shown in FIG. 1. In lieu of a power switch 142, a variable resistor such as a rheostat 144 can be utilized. The use of the rheostat 144 would allow the speed of the electric motor 102 to be varied and controlled by the rider. Additionally, the hand-held control could also be designed to utilize wireless technology.

When the rider closes the power switch 142, power is applied to the electric motor 102 causing the motor 102 to rotate which causes the rear fifth wheel 86 to rotate, further causing the motorized skateboard 10 to be propelled forward. The forward motion of the motorized skateboard 10 continues as long as the rider depresses the power switch 142.

While the invention has been described in detail and pictorially shown in the accompanying drawings it is not to be limited to such details, since many changes and modifications may be made to the invention without departing from the spirit and the scope thereof. For example, a disk brake 148 can be installed on one side of the rear drive wheel 86. Hence, it is described to cover any and all modifications and forms which may come within the language and scope of the claims.

MOTORIZED SKATEBOARD

| Element Designation (For convenience of the Examiner, not part of the specification) | |
|---|---|
| 10 | Motorized Skateboard |
| 12 | Skateboard Deck |
| 14 | Upper Surface |
| 16 | Lower Surface |

-continued

MOTORIZED SKATEBOARD

| Element Designation (For convenience of the Examiner, not part of the specification) | |
|---|---|
| 18 | Front End |
| 20 | Rear End |
| 22 | |
| 24 | Front Truck |
| 26 | Right Axle |
| 28 | Right Wheel |
| 30 | Left Axle |
| 32 | Left Wheel |
| 34 | |
| 36 | Rear Truck |
| 38 | Right Axle |
| 40 | Right Wheel |
| 42 | Left Axle |
| 44 | Left Wheel |
| 46 | |
| 48 | |
| 50 | Rear-Wheel Drive Assembly |
| 52 | Right Side Plate |
| 54 | Outer Side |
| 56 | Inner Side |
| 58 | Front End |
| 60 | Right Axle Bore |
| 62 | Rear End |
| 64 | Right Wheel Axle Slot |
| 66 | |
| 68 | |
| 70 | Left Side Plate |
| 72 | Outer Side |
| 74 | Inner Side |
| 76 | Front End |
| 78 | Left Axle Bore |
| 80 | Rear End |
| 82 | Left Wheel Axle Slot |
| 84 | |
| 86 | Rear Fifth Drive Wheel |
| 88 | Axle |
| 90 | Right Side |
| 92 | Left Side |
| 94 | Drive-Receiving Sprocket |
| 96 | |
| 98 | Motor Attachment Structure |
| 100 | Rods |
| 102 | Electric Motor |
| 103 | Face Plate |
| 104 | Electrical Input |
| 106 | Motor Shaft |
| 108 | Drive Sprocket |
| 110 | Sprocket Drive Band |
| 112 | Drive Chain |
| 114 | Female Socket |
| 116 | Male Socket |
| 118 | Power Source |
| 120 | Rechargeable Battery Pack |
| 122 | |
| 124 | |
| 126 | Photovoltaic Cells |
| 128 | Generator |
| 130 | Battery Attachment Means |
| 132 | Cradle |
| 134 | Electrical Output |
| 136 | |
| 138 | |
| 140 | Cable Assembly |
| 142 | Power Switch |
| 144 | Rheostat |
| 146 | |
| 148 | Disk Brake |

The invention claimed is:

1. A motorized skateboard comprising:

a) a skateboard deck having an upper surface and a lower surface to which is attached a front truck having an axle that supports a pair of front wheels and a rear truck having an axle that supports a pair of rear wheels, b) a rear-wheel drive assembly that is attached to the lower surface of the skateboard deck, said assembly comprising:

(1) a right side plate and a left side plate each having a front end that respectively has a right axle bore and a left axle bore that are dimensioned to rotatably receive the respective axles of the rear truck, and a rear end that respectively has a right wheel axle slot and a left wheel axle slot, (2) a rear fifth drive-wheel that rotates about an axle haying a right side that fits into and is secured to the right wheel axle slot and a left side that fits into and is secured to the left wheel axle slot, wherein to the left axis is fixedly inserted a drive-receiving sprocket, (3) an electric motor having an electrical input and means for being attached between the right and left side plates, wherein said motor has a shaft that has attached a drive sprocket that is rotatably attached to the drive-receiving sprocket by means of a sprocket drive band, (4) a disk brake that is attached to one side of the rear fifth drive-wheel, wherein said brake is operated by a hand-controlled, cable-installed toggle mechanism that is operated by a rider of said motorized skateboard, and c) a power source having an electrical output that is connected to the electrical input on said electrical motor by means of a power switch that is operated by a rider of said motorized skateboard, wherein when the rider closes the power switch, power is applied to said motor allowing the motor to rotate which causes the fifth wheel to rotate, further gluing said motorized skateboard to be propelled forward as long as the rider depresses the power switch.

2. A motorized skateboard comprising:

a) a skateboard deck having an upper surface, a lower surface, a front end and a rear end, b) a front truck that is attached to the lower surface proximate the front end of the skateboard deck, wherein the front truck has a right axle that rotatably supports a right truck wheel and a left axle that rotatably supports a left truck wheel, c) a rear truck that is attached to the lower surface proximate the rear end of the skateboard deck, wherein the rear truck has a right axle that rotatably supports a right truck wheel and a left axle that rotatably supports a left truck wheel, d) a rear-wheel drive assembly that is attached to the lower surface of the skateboard deck, said assembly comprising:

(1) a right side plate having an outer side, an inner side, a front end having a right axle bore that is proximate the front end and that is dimensioned to rotatably receive the right axle of the rear truck, and a rear end having a right wheel axle slot, (2) a left side plate having an outer side, an inner side, a front end, a left axle bore that is proximate the front end and that is in alignment with the right axle bore and that is dimensioned to rotatably receive the left axle of the rear truck, and a rear end having a left wheel axle slot, (3) a rear fifth drive-wheel that rotates about an axle having a right side that fits into and is secured to the right wheel axle slot, a left side that fits into and is secured to the left wheel axle slot, wherein to the left side of the axle is rigidly inserted a drive-receiving sprocket, (4) a motor attachment structure attached between the inner sides of said right side plate and said left side plate, (5) an electric motor having a face plate, an electrical input, and that is dimensioned to be attached and secured to said motor attachment structure, wherein said motor has a motor shaft that has attached a drive sprocket that is in alignment with a drive receiving sprocket, (6) a sprocket drive band that is attached around the drive sprocket and the drive receiving sprocket, and e) a battery pack that is attached by an attachment means to the lower surface of the skateboard deck, wherein said battery pack has an electrical output that is connected to the electrical input on said electrical motor by a cable assembly having a power switch that is held and operated by a rider of said motorized skateboard, wherein when the rider closes the power switch, power is applied to said electric motor allowing the motor to rotate which causes said rear fifth drive wheel to rotate further causing said motorized skateboard to be propelled forward as long as the rider depresses the power switch.

3. The motorized skateboard as specified in claim 2 wherein the rear end of the right and left side plates extend upward relative to the front end of the plates.

4. The motorized skateboard as specified in claim 2 wherein the axle of the rear fifth drive wheel is positioned from ten to sixteen inches behind the axle of the rear truck.

5. The motorized skateboard as specified in claim 4 wherein the drive-receiving sprocket has a diameter of ranging from 3.5 to 7.0 inches and has teeth ranging from 32 to 67.

6. The motorized skateboard as specified in claim 2 wherein the rear fifth drive-wheel has a diameter that ranges from 4.0 to 10.0 inches.

7. A motorized skateboard comprising:

a) a skateboard deck having an upper surface, a lower surface, a front end and a rear end, b) a front truck that is attached to the lower surface proximate the front end of the skateboard deck, wherein the front truck has a right axis that rotatably supports a right truck wheel and a left axle that rotatably supports a left truck wheel, c) a rear truck that is attached to the lower surface proximate the rear end of the skateboard deck, wherein the rear truck has a right axle that rotatably supports a right truck wheel and a left axle that rotatably supports a left truck wheel, d) a rear-wheel drive assembly that is attached to the lower surface of the skateboard deck, said assembly comprising:

(1) a right side plate having an outer side, an inner side, a front end having a right axle bore that is proximate the front end and that is dimensioned to receive the right axle of the rear truck, and a rear end having a right wheel axle slot, 2) a left side plate having an outer side, an inner side, a front end, a left axle bore that is proximate the front end and that is in alignment with the right axle bore and that is dimensioned to receive the left axle of the rear truck, and a rear end having a left wheel axle slot, 3) a roar fifth drive-wheel that rotates about an axle having a right side that fits into and is secured to the right wheel axle slot, a left side that fits into and is secured to the left wheel axle slot, wherein to the left side of the axle is rigidly inserted a drive-receiving sprocket, (4) a motor attachment structure attached between the inner sides of said right side plate and said left side plate, wherein the motor attachment structure is comprised of two rods that extend inward between the right and left side plates, wherein the rods are attached to the face plate that is attached to said electric motor, 5) an electric motor having a face plate, an electrical input, and that is dimensioned to be attached and secured to said motor attachment structure, wherein said motor has a motor shaft that has attached a drive sprocket that is in alignment with the drive receiving sprocket, 6) a sprocket drive band that is attached around the drive sprocket and the drive receiving sprocket, and e) a battery pack that is attached by an attachment means to the lower surface of the skateboard deck, wherein said battery pack has an electrical output that is connected to the electrical input on said electrical motor by a cable assembly having a power switch that is held and operated by a rider of said motorized skateboard, wherein when the rider closes the power switch, power is applied to said electric motor allowing the motor to rotate which causes said rear fifth drive wheel to rotate further causing said motorized skateboard to be propelled forward as long as the rider depresses the power switch.

8. The motorized skateboard as specified in claim 7 wherein the electrical motor is comprised of a 24 volt d-c motor.

9. The motorized skateboard as specified in claim 7 wherein the drive sprocket attached to the motor shaft has a diameter ranging from 1.0 to 3.5 inches and has teeth ranging from 11 to 27.

10. The motorized skateboard as specified in claim 2 wherein said battery pack has an output of 24 volts d-c and is attached intermediate the front and rear trucks to provide an even distribution of weight.

11. The motorized skateboard as specified in claim 2 wherein said battery pack is rechargeable.

12. The motorized skateboard as specified in claim 2 wherein said battery pack attachment means comprises a cradle that is secured to the lower surface of the skateboard deck.

13. The motorized skateboard as specified in claim 2 wherein the sprocket drive band is comprised of a drive chain.

* * * * *

UNITED STATES PATENT AND TRADEMARK OFFICE

CERTIFICATE OF CORRECTION

PATENT NO. : 8,061,725 B1
APPLICATION NO. : 12/660882
DATED : November 22, 2011
INVENTOR(S) : James E. Hawkins It is certified that error appears in the above-identified patent and that said Letters Patent is hereby corrected as shown below:

Title Page, Item (54) Title: should read --MOTORIZED SKATEBOARD--.

Signed and Sealed this
Fourteenth Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,061,725 B1
APPLICATION NO. : 12/660882
DATED : November 22, 2011
INVENTOR(S) : James E. Hawkins It is certified that error appears in the above-identified patent and that said Letters Patent is hereby corrected as shown below:

Title Page, Item (54) and at Column 1, line 1, Title: should read --MOTORIZED SKATEBOARD--.

This certificate supersedes the Certificate of Correction issued February 14, 2012.

Signed and Sealed this
Twentieth Day of March, 2012

David J. Kappos

David J. Kappos
*Director of the United States Patent and Trademark Office*